United States Patent [19]

Gonzalez

[11] Patent Number: 5,031,758

[45] Date of Patent: Jul. 16, 1991

[54] ORGANIZER OR DISPLAY FOR JEWELRY AND ACCESSORIES

[76] Inventor: Carlota Gonzalez, 24 Hospital Ave., Danbury, Conn. 06810

[21] Appl. No.: 527,095

[22] Filed: May 22, 1990

[51] Int. Cl.[5] ..... B65D 85/18

[52] U.S. Cl. ..... 206/6.1; 211/13; 428/7

[58] Field of Search ..... 40/305, 316, 329, 124.1, 40/603, 617, 636; 206/6.1, 44 R, 423, 495, 566; 211/13, 60.1, 72, 113; 428/4, 7, 10, 28, 32; 434/83, 93, 95

[56] References Cited

U.S. PATENT DOCUMENTS

| | | | |
|---|---|---|---|
| 1,574,192 | 2/1926 | Gutterman | 211/13 |
| 3,105,243 | 10/1963 | Kampfe | 428/28 |
| 3,622,010 | 11/1971 | Renelt | 211/13 |
| 3,718,260 | 2/1973 | Sharp | 211/13 |
| 3,853,226 | 12/1974 | Hine | 40/124.4 |
| 4,172,521 | 10/1979 | Eubanks et al. | 206/388 |
| 4,531,638 | 7/1985 | Jacobozzi et al. | 206/388 |
| 4,671,415 | 6/1987 | Manhart | 211/13 |
| 4,749,088 | 6/1988 | Workman et al. | 211/13 |
| 4,760,920 | 8/1988 | Thomsen | 206/495 |
| 4,821,883 | 4/1989 | Miller | 206/566 |

FOREIGN PATENT DOCUMENTS

| | | | |
|---|---|---|---|
| 0326835 | 10/1920 | Fed. Rep. of Germany | 211/13 |
| 0825744 | 12/1959 | United Kingdom | 206/388 |
| 2054682 | 2/1981 | United Kingdom | 428/7 |

*Primary Examiner*—Jimmy G. Foster

*Attorney, Agent, or Firm*—John H. Crozier

[57] ABSTRACT

In one preferred embodiment, a vertical braid of bundles of yarn having means at one end by which the braid can be hung from a surface. Many different types of jewelry and accessory items can be attached by clamping or pinning the items to the braid or by inserting portions of the items between strands of yarn in the braid. In another aspect of the invention, the braid is affixed to a board on which is mounted other means for organizing or displaying jewelry and accessories. In a further aspect of the invention, the braid is affixed to a display stand.

14 Claims, 1 Drawing Sheet

ORGANIZER OR DISPLAY FOR JEWELRY AND ACCESSORIES

BACKGROUND OF THE INVENTION

1. Field of the Invention

The present invention relates generally to means for organizing or displaying jewelry and accessories and, more particularly, to a novel means for jewelry and accessory organization or display which is compact, attractive, easy to use, which permits convenient retrieval of the jewelry and accessories, and which is especially useful in the organization of women's and children's jewelry and accessories.

2. Background Art

A number of devices have been developed for the organization or display of jewelry and accessories and include boards with pegs from which such items may be hung or frames supporting pieces of fabric to which earrings may be fastened. Other methods of organizing such items include placing them in more or less sorted fashion in drawers or bins. A substantial limitation with the former types of devices is that they are limited in the forms of jewelry or accessories with which they may be used. For example, a pegboard may be unsuitable for holding certain kinds of earrings and a piece of fabric would be unsuitable for attachment thereto of a headband. The latter method can make convenient retrieval difficult, especially when a drawer or bin contains a large number of items, and does not afford an attractive means of display.

Children are frequently prone to merely pile such items in a drawer or on a dresser without much thought to the organization thereof and it would be desirable to have some means to which a child would be attracted to organize the child's own jewelry and accessories.

Accordingly, it is a principal object of the present invention to provide means for the organization or display of a wide variety of jewelry and accessory items.

A further object of the invention is to provide such means that is attractive.

An additional object of the invention is to provide such means from which the items may be conveniently retrieved.

Another object of the invention is to provide such means that is economically and easily constructed.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in one preferred embodiment, a vertical braid of bundles of yarn having means at one end by which the braid can be hung from a surface. Many different types of jewelry and accessory items can be attached by clamping or pinning the items to the braid or by inserting portions of the items between strands of yarn in the braid. In another aspect of the invention, the braid is affixed to a board on which is mounted other means for organizing or displaying jewelry and accessories. In a further aspect of the invention, the braid is affixed to a display stand.

BRIEF DESCRIPTION OF THE DRAWING

Understanding of the present invention and the various aspects thereof will be facilitated by reference to the accompanying drawing figures, in which.

DETAILED DESCRIPTION OF THE PREFERRED EMBODIMENTS

Figure 1:
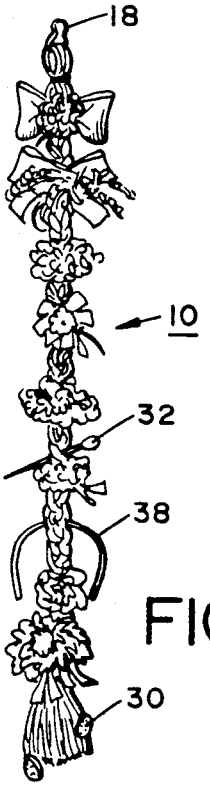
FIG. 1 is a front elevation view of one embodiment of the present invention.

Referring now to the Drawing, in which similar elements are given consistent identifying numerals throughout the various figures thereof, FIG. 1 illustrates an organizer or display comprising an elongate member, generally indicated by the reference numeral 10, according to the present invention.

Figure 2:
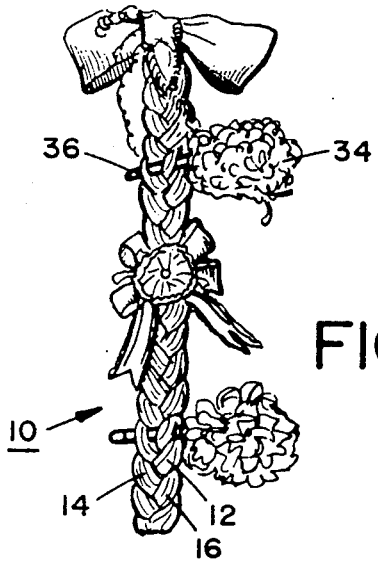
FIG. 2 is a partial view of the embodiment of FIG. 1.

As is more clearly seen by reference to FIG. 2, elongate member 10 is formed of three bundles of flexible strands of yarn or other material, 12, 14, and 16, preferably braided together. Attached to the top of elongate member 10 is a loop 18 (FIG. 1) so that the elongate member may be hung from a vertical surface. It can be seen that elongate member 10 is useful for holding a variety of jewelry and accessory items. For example, earring 30 is clamped to one or more strands of yarn of elongate member 10; stick pin 32 is simply inserted into bundle 12; hair ornamentation 34 has its clamping member 36 inserted between strands of yarn and may or may not be clamped shut (shown open on FIG. 2), and one end of rigid head band 38 is simply inserted into the member.

The length of elongate member 10 may be selected to hold any desired number of jewelry or accessory items and the items can be arranged thereon to provide an attractive display thereof. All items are easily accessible and conveniently retrievable. There is no need to sort through a pile or a drawer in order to select or find certain items. In particular, children would find that organizing their items using elongate member 10 would be an enjoyable task.

Figure 3:
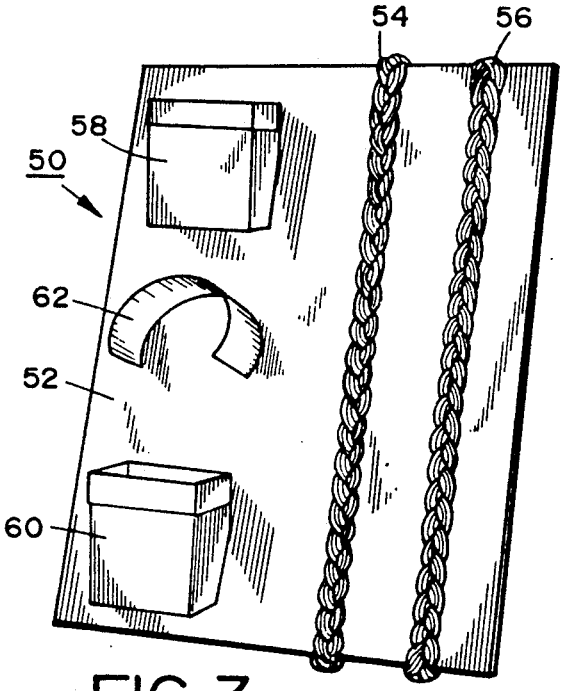
FIG. 3 is a perspective view of another embodiment of the present invention.

While it can be seen that elongate member 10 satisfactorily holds a wide variety of objects, there may be some items that may not be held suitably by the member or the items may be too numerous for such a member of reasonable length. An organizer or display of the present invention suitable for a large number of jewelry and accessory items of an even broader range of types is illustrated on FIG. 3 where it is generally indicated by the Reference numeral 50.

Organizer or display 50 includes a board 52 to which are affixed two elongate members 54 and 56, the latter members being identical in form and function to elongate member 10 on FIG. 1. To provide additional organizing capability, open top bins 58 and 60 affixed to board 52 are provided, into which bins may be inserted items which cannot be attached to elongate members 54 and 56 or to which it is desired not to attach the items.

To provide even greater organizing or display capability, arcuate support 62 is included so that items such as headbands and necklaces may be supported thereby.

Figure 4:
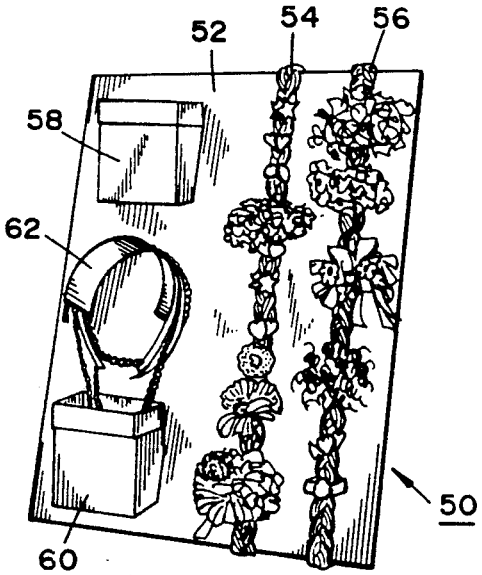
FIG. 4 is a perspective view of the embodiment of FIG. 3 with jewelry and accessories items thereon.

FIG. 4 illustrates organizer or display 50 with various jewelry and accessory items thereon.

Figure 5:
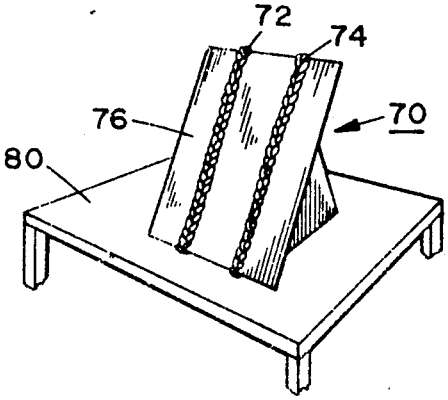
FIG. 5 is a perspective view of yet another embodiment of the present invention.

FIG. 5 illustrates an organizer or display stand, generally indicated by the reference numeral 70, which includes two elongate members 72 and 74 affixed to a board 76. Stand 70 may be placed on a table 80 and is especially useful for displaying items.

it will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. An organizer or display for jewelry and accessory items, comprising: a vertical, elongate member formed of three bundles of yarn braided together, and an article of jewelry attached thereto, said article of jewelry being selected from the group consisting of: an earring clamped to said yarn, a hair ornament with its clamping member inserted through said braided bundles of yarn, a headband with one end thereof inserted through said braided bundles of yarn, and a stickpin inserted into said braided bundles of yarn.

2. An organizer or display, as defined in claim 1, wherein said elongate member includes means to hang said elongate member from a vertical surface.

3. A display, as defined in claim 2, wherein said board includes means defining arcuate support attached thereto and extending therefrom.

4. An organizer or display, as defined in claim 1, further including a display board to which said elongate member is affixed.

5. An organizer or display, as defined in claim 4, wherein said board includes means defining bins attached thereto.

6. An organizer or display, as defined in claim 4, wherein said board includes means defining arcuate support attached thereto and extending therefrom.

7. An organizer or display, as defined in claim 4, wherein said board comprises part of a display stand.

8. An organizer or display for jewelry and accessory items, comprising:

(a) an elongate member formed of a plurality of flexible strands to which said items may be attached by clamping or pinning thereto or by inserting portions thereof between said flexible strands;

(b) a display board to which said elongate member is affixed; and (c) said board includes arcuate support means defining arcuate support attached thereto and extending therefrom.

9. An organizer or display, as defined in claim 8, wherein said flexible strands are yarn.

10. An organizer or display, as defined in claim 9, wherein said elongate member is a braid of bundles of yarn.

11. An organizer or display, as defined in claim 8, wherein said board includes means defining bins attached thereto.

12. An organizer or display, as defined in claim 8, wherein said board comprises part of a display stand.

13. A display for jewelry and accessory items, comprising:

(a) a display stand which includes an inclined board;

(b) an elongated member of braided strand attached to a flat surface of said board and extending along said flat surface, said elongated member adapted to have jewelry pinned and clamped thereon; and (c) means defining bins attached to said flat surface for holding additional items.

14. A display, as defined in claim 13, wherein said elongated member is a braid of bundles of yarn.

* * * * *

UNITED STATES PATENT AND TRADEMARK OFFICE

CERTIFICATE OF CORRECTION

PATENT NO. : 5,031,758

DATED : July 16, 1991

INVENTOR(S) : Carlota Gonzalez

It is certified that error appears in the above-indentified patent and that said Letters Patent is hereby corrected as shown below:

In column 3, claims 3 and 4 should be corrected to read as follows:

--3. An organizer or display, as defined in claim 1, further including a dispay board to which said elongated member is affixed.

4. A display, as defined in claim 2, wherein said board includes means defining arcuate support attached thereto and extending therefrom.--

Signed and Sealed this

Twenty-eight Day of February, 1995

Bruce Lehman

*Attest:*

BRUCE LEHMAN

*Attesting Officer*

*Commissioner of Patents and Trademarks*